US006578334B2

(12) United States Patent
Watanabe

(10) Patent No.: US 6,578,334 B2
(45) Date of Patent: Jun. 17, 2003

(54) BUILDING BOARD AND MANUFACTURING METHOD THEREOF

(75) Inventor: Morimichi Watanabe, Aichi (JP)

(73) Assignee: Nichiha Corporation, Nagoya (JP)

( * ) Notice: Subject to any disclaimer, the term of this patent is extended or adjusted under 35 U.S.C. 154(b) by 0 days.

(21) Appl. No.: 09/915,136

(22) Filed: Jul. 25, 2001

(65) Prior Publication Data

US 2002/0046509 A1 Apr. 25, 2002

(30) Foreign Application Priority Data

| | | |
|---|---|---|
| Jul. 25, 2000 | (JP) | 2000-224150 |
| Oct. 18, 2000 | (JP) | 2000-317772 |
| Nov. 20, 2000 | (JP) | 2000-353371 |

(51) Int. Cl.[7] ..... B44F 7/00

(52) U.S. Cl. ..... 52/314; 52/315; 52/316; 52/588.1; 52/592.1; 52/541; 52/591.4

(58) Field of Search ..... 52/314, 315, 316, 52/588.1, 592.1, 51, 591.4

(56) References Cited

U.S. PATENT DOCUMENTS

| | | | | |
|---|---|---|---|---|
| 3,908,326 A | * | 9/1975 | Francis | 52/541 |
| 4,287,693 A | | 9/1981 | Collette | |
| 5,885,502 A | * | 3/1999 | DeAngelis et al. | 52/316 |
| 5,989,369 A | * | 11/1999 | Light | 52/315 |

FOREIGN PATENT DOCUMENTS

| | | |
|---|---|---|
| DE | 24 40 497 | 3/1976 |
| DE | 3838301 | 5/1990 |
| DE | 19503948 | 8/1996 |
| EP | 0024360 | 3/1981 |
| FR | 2657104 | 7/1991 |
| JP | 56-112321 | 9/1981 |
| JP | 59-94536 | 1/1984 |
| JP | 10-18544 | 1/1989 |
| JP | 1-275856 | 11/1989 |
| JP | 3-78828 | 1/1991 |
| JP | 4-48332 | 4/1992 |
| JP | 63-21323 | 11/1994 |
| JP | 9-144268 | 6/1997 |
| JP | 9-150111 | 6/1997 |
| JP | 2000-129886 | 5/2000 |
| JP | 2000-170348 | 6/2000 |
| JP | 2001-227129 | 8/2001 |
| WO | WO 83/03867 | 11/1983 |

OTHER PUBLICATIONS

Examination Report from Australia Patent Office, Jun. 12, 2002.

Office Action issued Dec. 4, 2002 in related Japanese Application No. 2000–317772 (and Abridged Translation).

* cited by examiner

*Primary Examiner*—Carl D. Friedman
*Assistant Examiner*—Nahid Amiri
(74) *Attorney, Agent, or Firm*—Shook, Hardy & Bacon L.L.P.

(57) ABSTRACT

A building board which is provided on the surface thereof with a concave and convex pattern, and opposite sides thereof with overlying rabbeted portions (2-1, 6-1, 6-2) and underlying rabbeted portions (3-1, 3-2, 5-1), respectively, wherein each overlying rabbeted portion (2-1, 6-1, 6-2) is constituted by one end portion of the convex portion (2, 6) of said pattern; each underlying rabbeted portion (3-1, 3-2, 5-1) is constructed to have an area bigger than the area of corresponding overlying rabbeted portion (2-1, 6-1, 6-2) bearing said convex portion and formed on the opposite side; and each of said opposite sides is provided on the rear side thereof with a linear contact surface (7-1, 7-2).

6 Claims, 13 Drawing Sheets

(a)

(b)

BUILDING BOARD AND MANUFACTURING METHOD THEREOF

BACKGROUND OF THE INVENTION

1. Field of the Invention

The present invention relates to a building board and the manufacturing method thereof. In particular, the present invention relates to a building board which is improved in the structure of side joint portions thereof so as to ensure the continuity of design or pattern between neighboring building boards having such a design or pattern, thereby making it possible to enhance the external decorative appearance of entire board siding, and to the manufacturing method thereof.

2. Description of the Related Arts

At present, about 70% of siding board for building is occupied by a ceramic type siding board, and the design or pattern thereof tends to become increasingly elaborate and complicated. However, even if each unit of siding board is made elaborate in design, it would be impossible to obtain a satisfactory external decorative appearance of entire board siding if the continuity of design or pattern is lost at the joint portion between neighboring siding boards. Since ceramic type building boards (or siding boards) are generally manufactured in the form of lengthy plate, a linear gap is unavoidably formed at the joint portion between neighboring building boards in the ordinary situation, thereby making it difficult to secure the continuity of design or pattern at this joint portion. This problem will be encountered not only in the case of butt joint work but also in the case of shiplap joint work.

In the case of a building board having a masonry pattern such as a brick-like pattern or a tile-like pattern which is popularly employed as a design for ceramic type building boards, various ideas have been proposed so as to prevent the joint portion between neighboring boards from standing out. For example, Japanese Patent Unexamined Publication 2000-129886; Japanese Patent Unexamined Publication H9-144268; Japanese Patent Unexamined Publication H9-150111; Japanese Utility Model Unexamined Publication H3-78828; and Japanese Utility Model Unexamined Publication S56-112321 propose various measures so as to prevent the joint portion between neighboring boards from standing out even in a situation wherein the masonry pattern applied to a building board is partially separated into two, i.e. a portion of the unit design is applied to one of neighboring pair of building boards and the remaining portion of the unit design is applied to the other building board, these separated portions of unit design being subsequently integrated into a complete unit design when the pair of building boards are joined together. On the other hand, Japanese Utility Model Unexamined Publication S63-21323 discloses an idea wherein each unit design of pattern is not separated but is entirely placed on either one of neighboring pair of building boards, thereby allowing it to partially protrude from said either one of neighboring pair of building boards, and this protruded portion of unit design is allowed to extend over one side portion of the other one of neighboring pair of building boards when the neighboring pair of building boards are joined together, thereby preventing the joint portion from standing out.

However, the aforementioned idea of separating one unit design into two parts which are subsequently integrated into a complete unit design when the pair of building boards are joined together so as to secure the continuity of pattern is accompanied with a problem that although the entire molding work of the building board including the molding work of the side joining portion thereof may be simplified, it is impossible to completely hide the linear contact line (joint line), exposing it from the surface of pattern, and hence the idea is not satisfactory in terms of ensuring the continuity of designed pattern as a whole. Further, it would be impossible to prevent rain water from entering into the rear side of the building board through a gap to be formed at the linear joint portion appearing all over the surfaces of building boards.

On the other hand, the aforementioned idea of entirely placing the unit design on either one of neighboring pair of building boards, thereby allowing it to partially extend over one side portion of the other one of neighboring pair of building boards when the neighboring pair of building boards are joined together, may be advantageous in the respects that it is possible to secure the integration of pattern and to prevent the joint line from standing out as the joint line is interrupted by the crossing of the protruded portion of unit design, thus making it possible to obtain a satisfactory appearance of building wall, and that the gap at the joint portion can be partially covered by the surface portion of the building board, thereby making the gap discontinuous, and hence making it possible to prevent the invasion of most of rain water. However, it would be difficult to perform the molding work of the side portion (or joint portion) of the building board, so that it would be difficult to actually employ this method in the case where a large quantity of building boards are required to be continuously molded.

This invention has been accomplished in view of the aforementioned circumstances, and the object of this invention is to provide a building board which makes it possible to easily perform the entire molding work thereof including the molding work of the side joining portion thereof, to ensure the integration of pattern as a whole, and to hide the joint line between a pair of neighboring building boards from outside due to the covering of most of the joint line by the pattern, thus obtaining a satisfactory external appearance of a building wall exhibiting an excellent continuity of design or pattern as a whole, and effectively preventing invasion of rain water from the surface of the building wall.

SUMMARY OF THE INVENTION

Namely, the building board to be provided by the present invention for solving the aforementioned problem is featured in that it is provided on the surface thereof with a recessed and protruding pattern, and on at least opposite sides thereof with at least one overlying rabbeted portion and at least one underlying rabbeted portion, respectively, wherein each overlying rabbeted portion is constituted by one end portion of the protruding portion of said pattern; each underlying rabbeted portion is constructed to have an area bigger than the area of corresponding overlying rabbeted portion bearing said protruding portion and formed on the opposite side; and each of said opposite sides is provided on the rear side thereof with a linear contact surface.

Preferably, each protruding portion has a shape like an island, and these overlying rabbeted portions and underlying rabbeted portions are disposed on the sides of the building board in a manner to avoid the formation of a linear joint on the external surface of the buiding board as a couple of building boards are coupled with each other.

According to the building board mentioned above, the coupling of neighboring pair of building boards is performed by two ways of joint, i.e. so-called butt joint wherein a couple of the linear joints formed on the rear side of the building board are contacted face to face, and so-called shiplap joint wherein an overlying rabbeted portion of one of the building boards is superimposed over an underlying rabbeted portion of the other building board. In this case, the butt joint portion is hidden by the shiplap joint covering the front side of the butt joint portion, so that any gap formed by the butt joint can be hardly recognized as it is viewed externally, and even if the gap can be externally recognized, only a discontinuous state thereof can be recognized, thus not giving any incompatibility to anyone. Further, since the gap at the butt joint portion can be covered by the shiplap joint portion, the area of the gap to be exposed from the surface of the building board can be minimized, thereby effectively inhibiting the aforementioned invasion of rain water. Furthermore, since the protruding portion which is disposed on a side portion of the building board is entirely retained as it is on the overlying rabbeted portion without being partitioned, not only the integration of design but also the continuity of pattern can be concurrently secured. Therefore, it becomes possible, as in the case where each protruding portion has a shape like an island, to easily form a zigzag groove at the joint portion of a couple of building boards.

In a preferable embodiment of the present invention, one of the linear contact surface is provided with a tongue, and the other of the linear contact surface is provided with a groove for enabling the tongue to be fitted therein. In another preferable embodiment, at least one underlying rabbeted portion is provided on the contact surface side thereof with a step portion having a predetermined width, and the portion of said overlying rabbeted portion corresponding to said step portion has an increased thickness which is increased by the height of said step. It becomes possible, according to these preferable embodiments, to effectively and reliably prevent the rain water that has entered through the exposed gap at the butt joint portion or through joint portion of the shiplap joint portion from turning into the rear side of the building board through these joint portions.

In a preferable embodiment of the present invention, at least one underlying rabbeted portion is provided with a deeply recessed portion which is opened toward the side of said building board; and a portion of said overlying rabbeted portion which corresponds to said deeply recessed portion is formed to have an increased thickness which is larger than the other portions of said overlying rabbeted portion by a magnitude corresponding to that of said deeply recessed portion. According to this preferable embodiment, it becomes possible to easily perform the positioning in the horizontal direction of a neighboring couple of building boards by enabling the distal end face of the thick overlying rabbeted portion to be contacted with the inner end face of the deeply recessed portion on the occasion of coupling a horizontally neighboring couple of building boards.

Therefore, when the deeply recessed portion of the underlying rabbeted portion is formed at a predetermined position by means of embossing work, etc., the width of the recessed portion in a recessed and protruding pattern can be easily made uniform at the joint portion between the horizontally neighboring couple of building boards, thereby making it possible to reliably coincide the zigzag recessed pattern of the joint portion with the zigzag recessed pattern formed on the other surface portion of the building board. As a result, the continuity of pattern or design all over the entire external wall surface can be more reliably secured. Further, since the installing work of building boards is performed by fitting the overlying rabbeted portion in the deeply recessed portion of the underlying rabbeted portion, it becomes possible to prevent the lifting of the building board from standing out even if the installing work of building boards is found defective more or less.

Furthermore, it is easy to perform the positioning of the joining end faces of the horizontally neighboring couple of building boards in such a manner that the linear joining end faces formed on the rear side of each of the horizontally neighboring couple of building boards are prevented from being directly contacted with each other as these building boards are positioned in place. As a result, a caulking material can be interposed at this gap between these linear joining end faces, thereby reliably ensuring the waterproofness of this joint portion.

Additionally, since the underlying rabbeted portion is provided with this deeply recessed portion, a step portion is caused to be formed at the engaging portion between the overlying rabbeted portion and the underlying rabbeted portion. Therefore, the rain water that has entered from the zigzag design portion at the joint portion can be prevented from flowing into the rear side of the building board by this step portion, thereby forcing the rain water to flow toward the front side of the building board. As a result, rain water can be prevented from leaking into the rear side of the building board through the joint portion between the linear joining end faces formed on the rear side of each of building boards.

The present invention also provides a method of manufacturing said building boards, comprising the steps of forming regions of reduced thickness for said underlying rabbeted portions on a building board material by means of embossing work, subjecting the building board material to a curing treatment, and cutting out rear side portions of predetermined lengths from the side edges of the building board material transversely along the entire widths of the side edges at the same thickness as the thickness of said underlying rabbeted portion, thereby forming overlying rabbeted portions at regions which have not been reduced in thickness in said embossing work and at the same time, forming a linear contact surface on each cut out sections.

In a preferable embodiment of the present invention, the method of manufacturing building boards further comprises a step of forming a tongue and a groove respectively on each linear surface.

In another preferable embodiment of the present invention, the method of manufacturing building boards comprises steps of forming regions of reduced thickness including at least one thin region for said underlying rabbeted portions on a building board material by means of embossing work, subjecting the building board material to a curing treatment, cutting out a rear side portion of a predetermined length from one side edge of the building board material transversely along the entire width of the side edge at the same thickness as the thickness of said reduced thickness, cutting out a rear side portion of a predetermined length from the other side of the building board material to an extent which corresponds to the thickness of the reduced thickness, and further cutting out a rear side portion of a predetermined length from said other side of the building board material to an extent which corresponds to the thickness of the thin region transversely along the entire width of the side edge In the case of manufacturing said building board provided with a deeply recessed portion following the above method, at one side of the building board material, at least one region of reduced thickness including a shallowly recessed portion and a deeply recessed portion opened toward the side of said building board material is formed in advance by means of embossing work, while at the other side of the building board material, at least one region of reduced thickness including, in the outer side, a region of greatly reduced thickness having the same thickness as the thickness of said deeply recessed portion and, in the inner side, a region of slightly reduced thickness having the same thickness as the thickness of said shallowly recessed portion is formed in advance by means of embossing work. Then, after subjecting the building board material to a curing treatment, at said one side of the building board material, a rear side portion of a predetermined length from the side edge is cut out transversely along the entire width of the side edge at the same thickness as the thickness of said shallowly recessed portion. At said other side of the building board material, a rear side portion having the same length as the length of said deeply recessed portion is cut out transversely along the entire width of the side edge at the same thickness as the thickness of said deeply recessed portion. As a result, overlying rabbeted portions of two different thicknesses are formed at the portions which have not been reduced in thickness, and at the same time, a linear contact surface is formed on each cut out sections.

As for the step of forming a region of reduced thickness by means of embossing work at the region to be subsequently formed into an underlying rabbeted portion in the aforementioned manufacturing method, it can be performed in the same manner as in the case of the conventional embossing work of forming a pattern or design on an embossing surface of material. This step of forming regions of reduced thickness can be easily performed. The work of forming regions of reduced thickness by means of embossing work can be performed concurrent with the work of forming a design or pattern on an embossing surface, thereby making it possible to further simplify these embossing work as a whole.

The subsequent work of partially cutting out the both end portions of a building board transversely along the entire width thereof to such an extent that corresponds to the thickness of the aforementioned thinned region can be performed in the same manner as in the cutting work of the overlying rabbeted portion or underlying rabbeted portion in the conventional manufacturing method of a building board, and hence this can be quite easily performed. Further, since the linear joint end faces can be formed on the rear sides of building boards simultaneous with the aforementioned work of partially removing the both end portions of the building board, the number of steps for entirely working the building board according to the present invention would become the same as that of the conventional method. Therefore, there would be raised little inconvenience even if the aforementioned manufacturing method is applied to the method of continuously manufacturing a large number of building boards of the same specification.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will be further explained with reference to drawings showing preferable embodiments of a building board and the manufacturing method according to the present invention.

Figure 1:
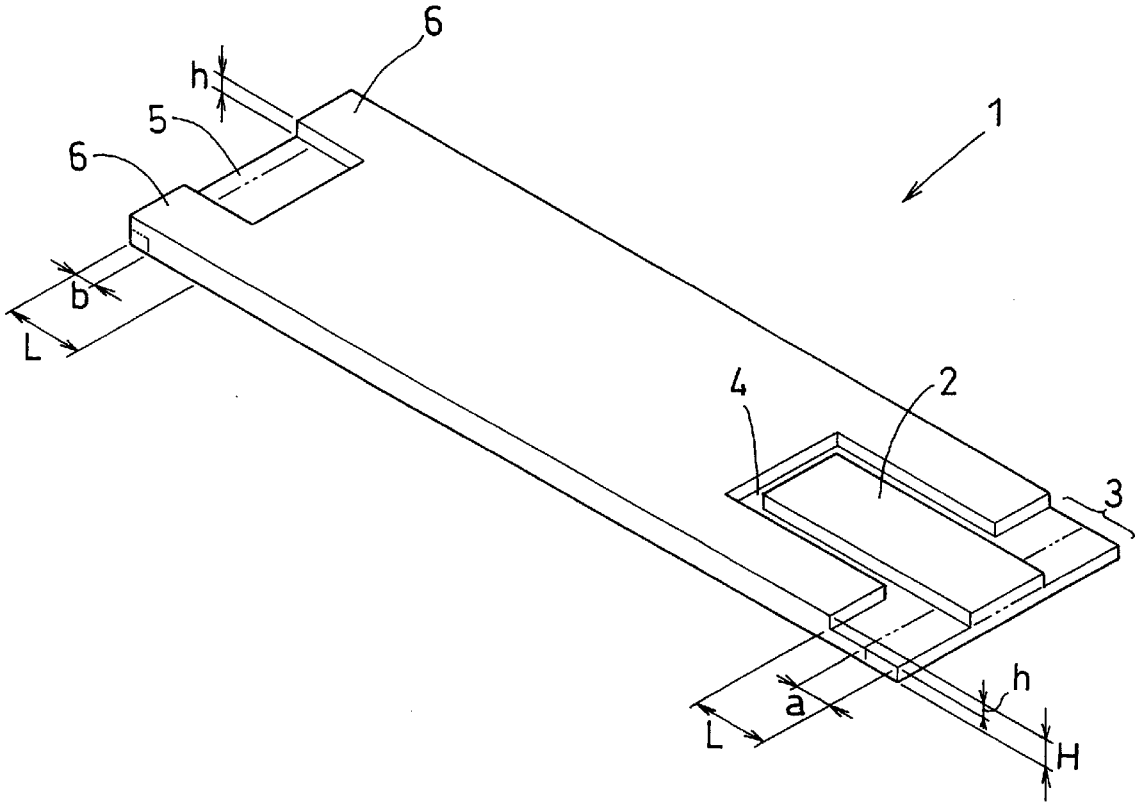
FIG. 1 is a perspective view illustrating an intermediate product of a building board according to the present invention.
Figure 2:
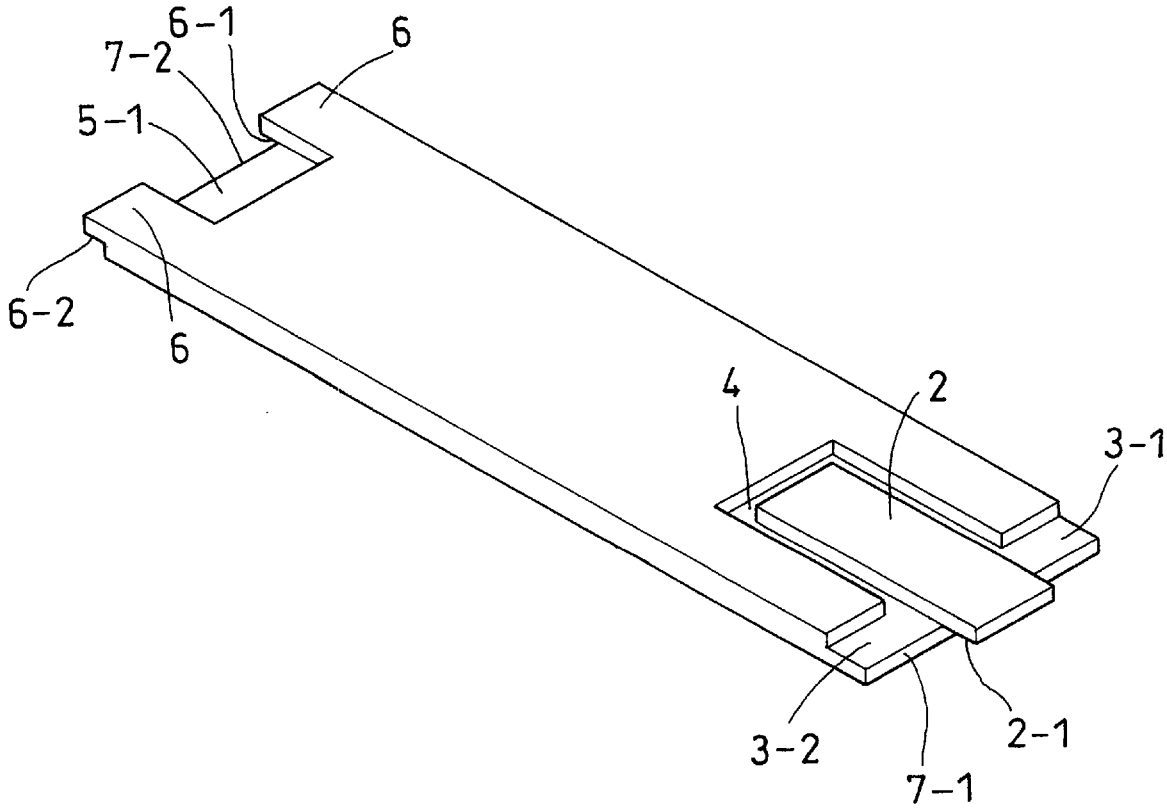
FIG. 2 is a perspective view illustrating the finished product of the building board shown in FIG. 1.
Figure 3:
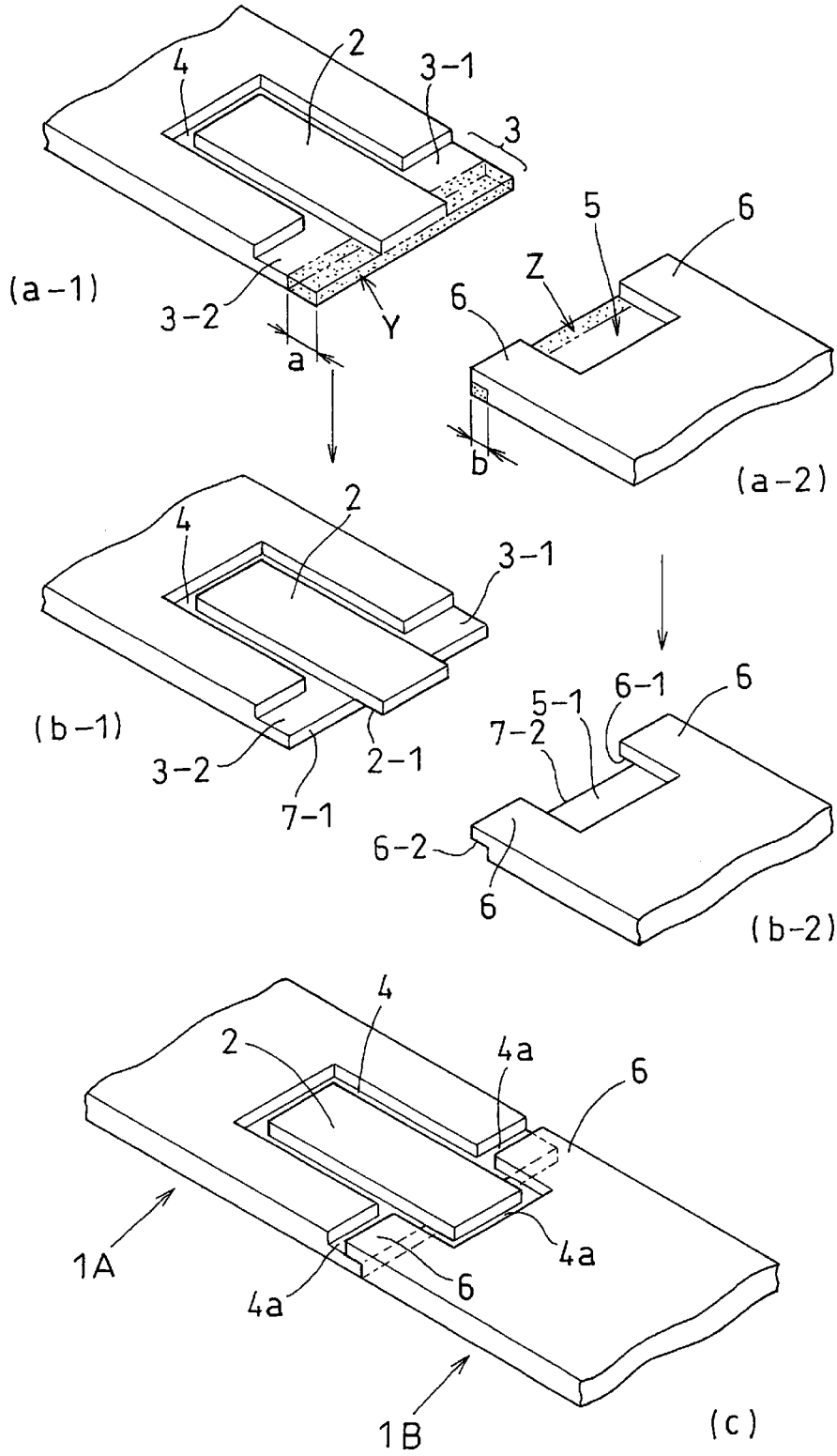
FIG. 3 is a perspective view illustrating manufacturing steps of the building board shown in FIG. 1.
Figure 9:
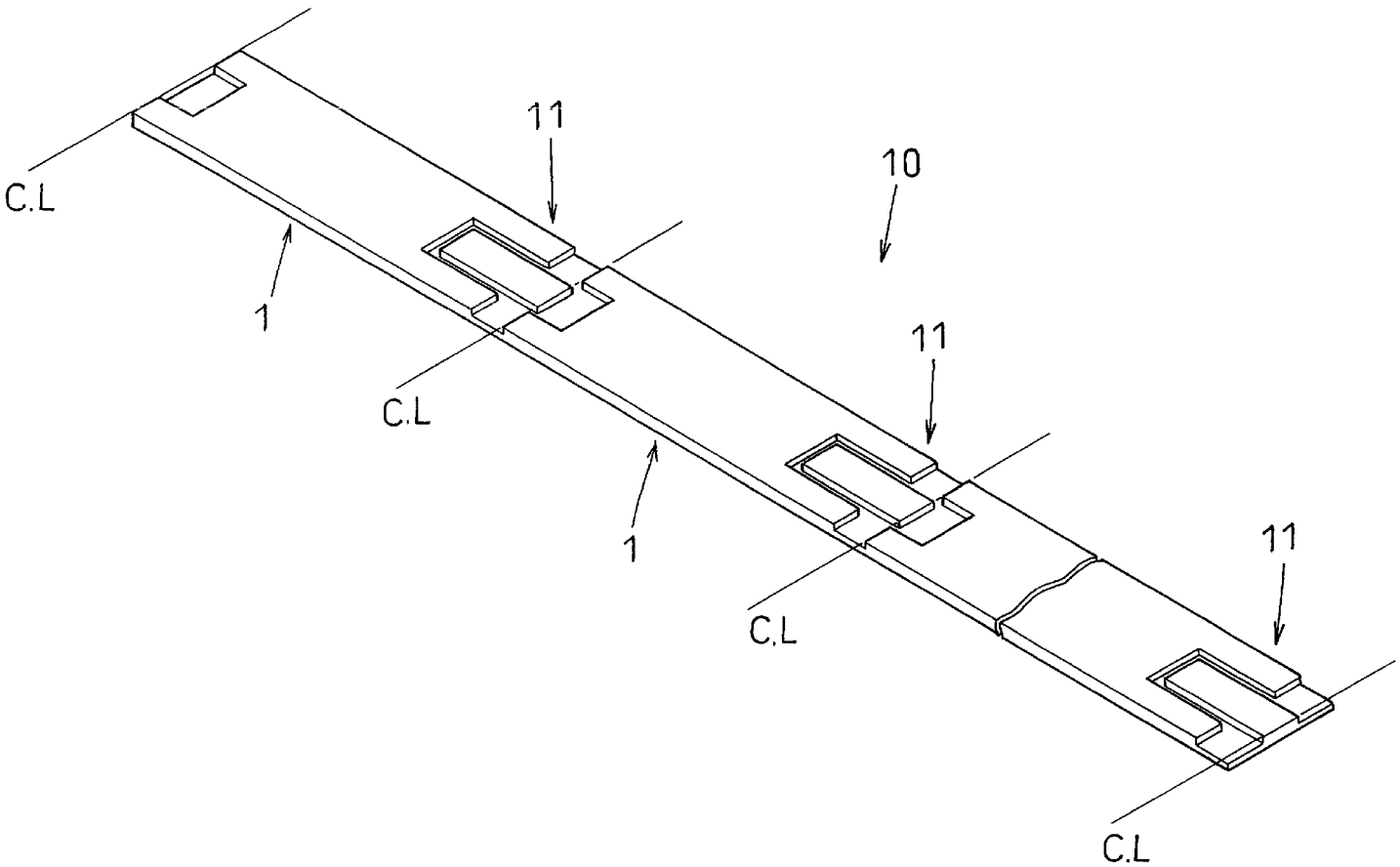
FIG. 9 is a perspective view illustrating an intermediate product of a building board according to another embodiment of the present invention.
Figure 10:
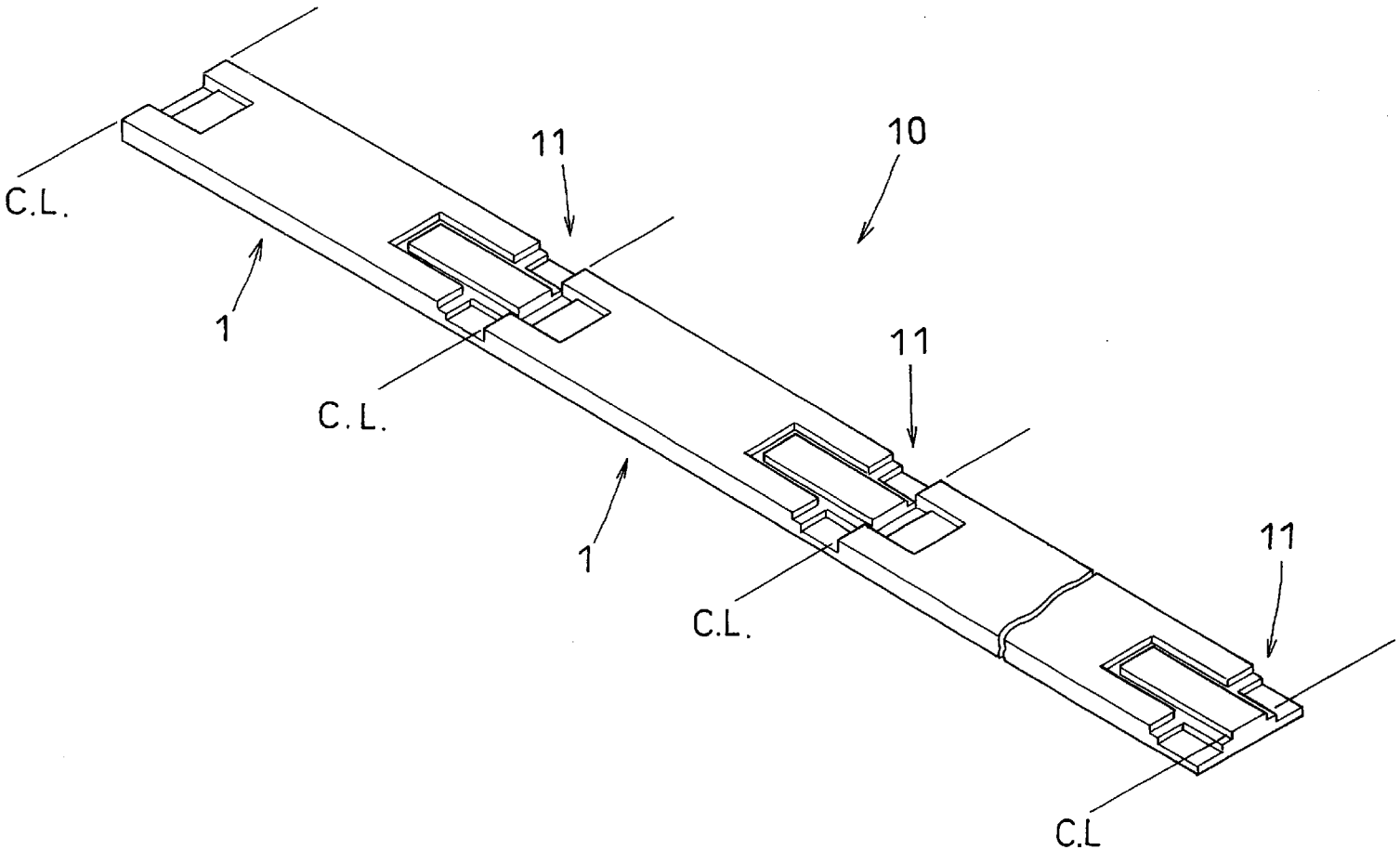
FIG. 10 is a perspective view illustrating an intermediate product of a building board according to further embodiment of the present invention.

FIG. 1 shows an intermediate product of building board in the manufacturing method of a building board according to the present invention; and FIG. 2 shows a finished product. FIG. 3 illustrates the manufacturing steps of the building board according to the present invention. FIGS. 9 and 10 shows another embodiment of intermediate product of a building board in the manufacturing method of a building board according to the present invention. In FIGS. 1 to 13, the configuration of a building board is extremely simplified for the sake of simplifying the explanation of working steps of the configuration of the side portions (including the configuration of the vicinity thereof) of the building board, which represents the characteristic features of the present invention. In the actual product however, a far many number of designs or patterns (convex pattern or concave/convex pattern) are formed all over the surface of a building board.

FIGS. 1 to 3 illustrate one example wherein the manufacturing method of the present invention is applied to a board which is formed of cement and kept in a semi-fluid state, the board having a size corresponding to one sheet of a building board and manufactured according to the ordinary manufacturing process (it may be a dry forming method or a wet forming method). The example shown in FIGS. 1 to 3 is simplified for the convenience of explanation, so that the manufacturing method of the present invention can be applied to the case where a plurality of unit boards are concurrently produced from a single raw material sheet of large size as explained hereinafter.

First of all, an embossing work of the configuration as shown in FIG. 1 is performed on the surface of flat rectangular board 1 being kept in a semi-fluid state and having a thickness H by making use of a predetermined emboss mold (not shown). Namely, as shown in FIG. 1, a single protruding portion 2 is formed at approximately a central portion (in the vertical direction) of the right side of the board 1. Further, a recessed region 3 which is reduced in thickness by a depth h is formed respectively on the upper and lower sides of the protruding portion 2, this recessed region 3 extending from the right edge of the board 1 toward the central portion of the board 1 for a distance of L. Preferably, the depth h should be about ½ of the thickness of the board 1. Further, a groove 4 preferably having the same depth h as that of the region 3 is formed around the protruding portion 2 (this groove 4 corresponds to the concave pattern of the actual building board). On the other side of the board 1, i.e. the left side in FIG. 1, a recessed portion 5 is formed in conformity in location with the aforementioned protruding portion 2, this recessed portion 5 being reduced in thickness by a depth of h, having a lateral width (in the vertical direction) which corresponds to the total of the lateral width of the protruding portion 2 and the combined width of the grooves 4 formed on opposite sides of the convex portion 2, and extending from the left edge of the board 1 toward the central portion of the board 1 for a distance of L (the same as that of region 3). The regions 6 located below and over the recessed portion 5 will become part of the protruding pattern in the actual building board.

Then, the intermediate product shown in FIG. 1 (the board 1 which has been subjected to the embossing work) is released from the embossing mold, and after being subjected to a curing treatment, etc., an ordinary rabbet joint-forming work is performed, and at the same time, a cutting work shown in FIG. 3 is performed. By the way, this cutting work is performed after a coating treatment which is usually performed after the step of the ordinary rabbet joint-forming work. Specifically, this cutting work may be performed as shown in FIG. 3. Namely, a portion of Y of board 1 which corresponds in distance to "a" as measured from the right edge of the board 1 toward the central portion thereof (wherein a<L) and in thickness to the thickness of the recessed region 3 (i.e. H-h: ½ of the thickness of board) is cut off transversely along the entire width of the right edge portion (FIG. 3, a-1). As a result, an overlying rabbeted portion 2-1 extending right-ward for a distance of "a" and having a thickness h (½ of the thickness of board) as measured from the surface of board is formed on a right portion of the protruding portion 2 which is located on the right edge of the board 1. Further, a first underlying rabbeted portion 3-1 and a second underlying rabbeted portion 3-2, each having a depth h (½ of the thickness of board) as measured from the surface of board, are formed on the upper and lower sides of the protruding portion 2 excluding the portion constituting the overlying rabbeted portion 2-1. Concurrently, on the rear side of the board 1, there is formed a linear end face 7-1 which is extended along the line coinciding with the right end faces of these first and second underlying rabbeted portions 3-1 and 3-2 (FIG. 3, b-1).

Likewise, a cutting work is also performed on the left side of board. Namely, a portion Z of board 1 which corresponds in distance to "b" (b<a; preferably, the value of a–b should be the width of the groove 4) as measured from the left edge of the board 1 toward the central portion thereof and in thickness to a thickness of H-h (½ of the thickness of board) is cut out transversely from the rear side thereof and along the entire width of the left edge portion (FIG. 3, a-2). As a result, a region located left-ward of the recessed portion 5 is cut out for a distance of "b". As a result, an underlying rabbeted portion 5-1 having a width L-b (in the longitudinal direction of board), and at the same time, a first overlying rabbeted portion 6-1 and a second overlying rabbeted portion 6-2, each having a thickness h (½ of the thickness of board) as measured from the surface of board and having a length of "b" as measured from the left edge of board, are formed at the regions 6 located on the upper and lower sides of the recessed portion 5. Concurrently, on the rear side of the board 1, there is formed a linear end face 7-2 which is extended along the line coinciding with the left end face of the underlying rabbeted portion 5-1 (FIG. 3, b-2).

The aforementioned manufacturing steps can be performed continuously, and a large number of the building boards can be manufactured according to almost the same system as the conventional manufacturing system. In the installation of the building boards onto the wall of building, a many number of the building boards can be attached to the wall of building by way of a horizontal board siding while joining together the Bide portions of neighboring right and left building boards. As shown in FIG. 3*c*, in the installation of two building boards 1A and 1B for instance, the overlying rabbeted portion 2-1 of the protruding portion 2 formed at the right edge portion of the building board 1A is allowed to engage with the underlying rabbeted portion 5-1 formed on the left edge portion of the building board 1B, thereby achieving a shiplap engagement between the two building boards, and at the same time, the first underlying rabbeted portion 3-1 and the second underlying rabbeted portion 3-2, both formed on the right edge portion of the building board 1A, are allowed to engage with the first overlying rabbeted portion 6-1 and the second overlying rabbeted portion 6-2 formed on the left edge portion of the other building board 1B, respectively, thereby achieving a shiplap engagement between them. In this case, a zigzag groove pattern 4*a* having the width of the groove can be formed at the shiplap joint portion. Concurrently, the linear end face 7-1 formed on the rear surface of right side portion of the building board 1A is brought to face the linear end face 7-2 formed on the rear surface of left side portion of the building board 1B, whereby a linear butt joint is effected at this portion. In the actual installation work of building boards, a resilient sealing material is introduced into this butt joint portion to thereby ensure the waterproofness at this joint portion.

As explained above, according to the building board mentioned above, the coupling of neighboring pair of building boards 1A and 1B is performed by two ways of joint, i.e. the linear butt joint on the rear side of building boards, and the shiplap joint on the surface side of building boards. In this case, the butt joint portion can be hidden by the shiplap joint covering the front side of the butt joint portion, so that any gap formed by the butt joint can be hardly recognized as it is viewed externally, and even if the gap can be externally recognized as shown in the drawings, only a discontinuous state thereof can be recognized, thus not giving any incompatibility to anyone. Further, since the gap at the butt joint portion can be covered by the shiplap joint portion, the area of the gap to be exposed from the surface of the building board can be minimized, thereby effectively inhibiting the aforementioned invasion of rain water. Further, since the protruding unit design 2 which is disposed on a side edge portion of the building board is entirely retained as a unit design at one side of the protruding portion in the form of overlying rabbeted portion 2-:L without being partitioned, not only the integration of design but also the continuity of pattern can be concurrently secured. Therefore, it becomes possible, as in the case where each protruding portion has a shape like an island, to easily form a zigzag groove at the joint portion of a couple of building boards. Further, the waterproof work at the butt joint portion can be easily and reliably performed by making use of a sealing material.

Figure 4:
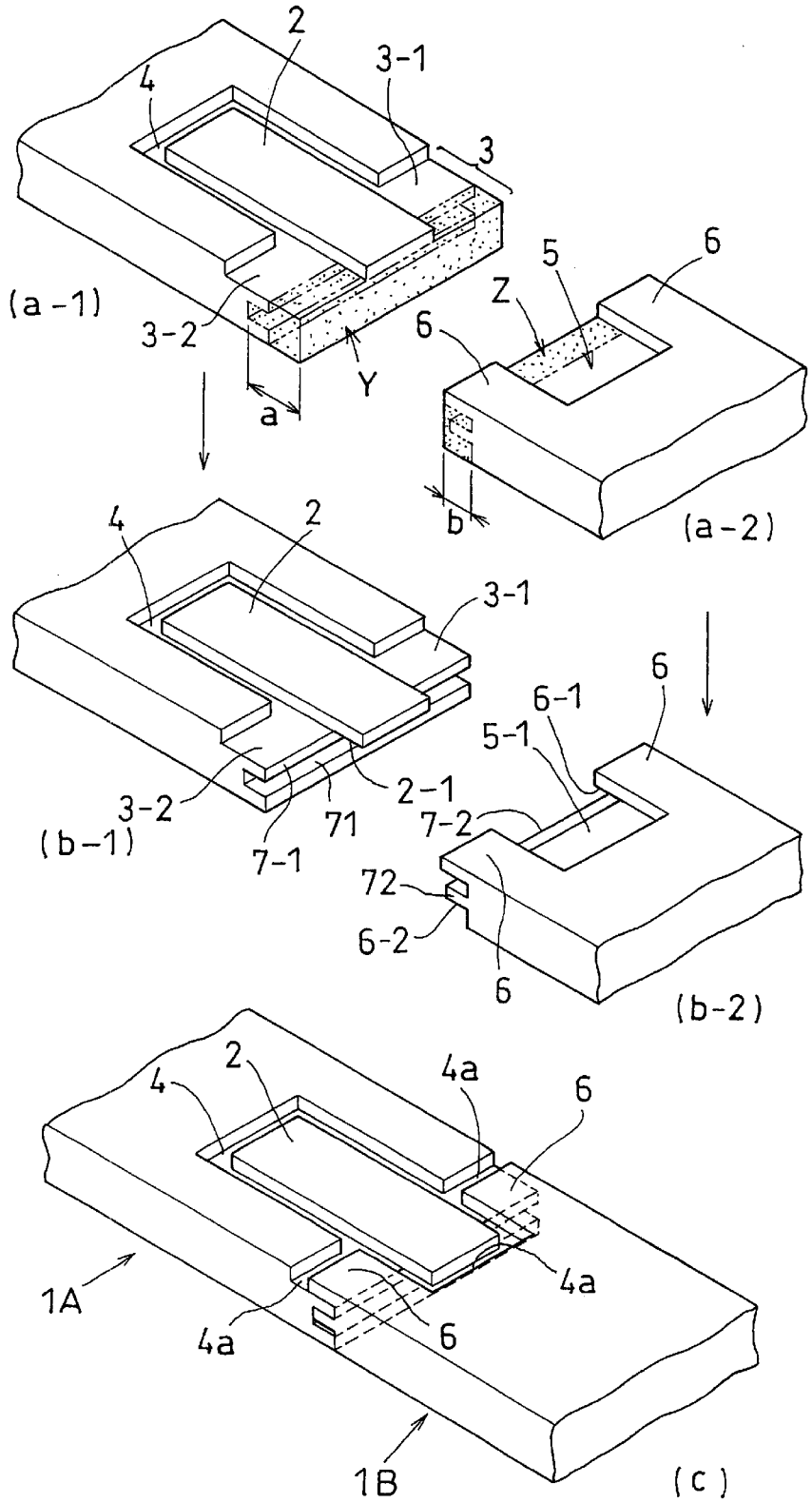
FIG. 4 is a perspective view illustrating manufacturing steps of another embodiment of a building board according to the present invention.

FIG. 4 shows another embodiment of a building board according to the present invention, which approximately corresponds to the embodiment of FIG. 3. In FIG. 4, the same members functioning in the same manner are identified by the same symbols, thereby omitting the explanation thereof. In this building board 1, a groove 71 is formed laterally traversing the linear end face 7-1 which is formed on the rear side at the right side of the building board 1A. Likewise, a tongue 72 to be inserted into this groove 71 is formed laterally traversing the linear end face 7-2 which is formed on the rear side at the left side of the building board 1B. The production of these groove 71 and tongue 72 can be easily performed, as explained with reference to FIG. 3, by cutting out the Y and Z regions in the same manner as in the case of ordinary shiplap joint-forming work. The building board 1 shown in FIG. 4 is constructed to have an increased thickness as compared with the building board of the aforementioned first embodiment for the purpose of securing a sufficient strength of the groove 71 and tongue 72, the thickness of them may not be so large as long as a predetermined strength of them can be ensured. It is also possible to increase the thickness of the thinned region 3 and to make shallower the depth of the groove 4 for the purpose of securing a predetermined strength of these groove 71 and tongue 72.

This building board is featured in that, as shown in FIG. 4*c*, in addition to the linear butt joint which is to be formed by a combination of the linear end face 7-1 formed on the rear side at the right side of one building board 1A and the linear end face 7-2 formed on the rear side at the left side of the other building board 1B, so-called tongue and groove joint constituted by the groove 71 and the tongue 72 to be inserted into the groove 71 is also formed at this butt joint portion, so that rain water that has entered into the joint portions of the building boards via the exposed gap at the butt joint portion or via the shiplap joint portion can be effectively interrupted by this tongue and groove joint, thereby making it possible to reliably prevent rain water from turning into the rear side of the building boards via these joint portions. Therefore, the introduction of sealing material into the gap of the butt joint portion can be omitted. In any way, the waterproofness of the joint portions can be ensured.

Figure 5:
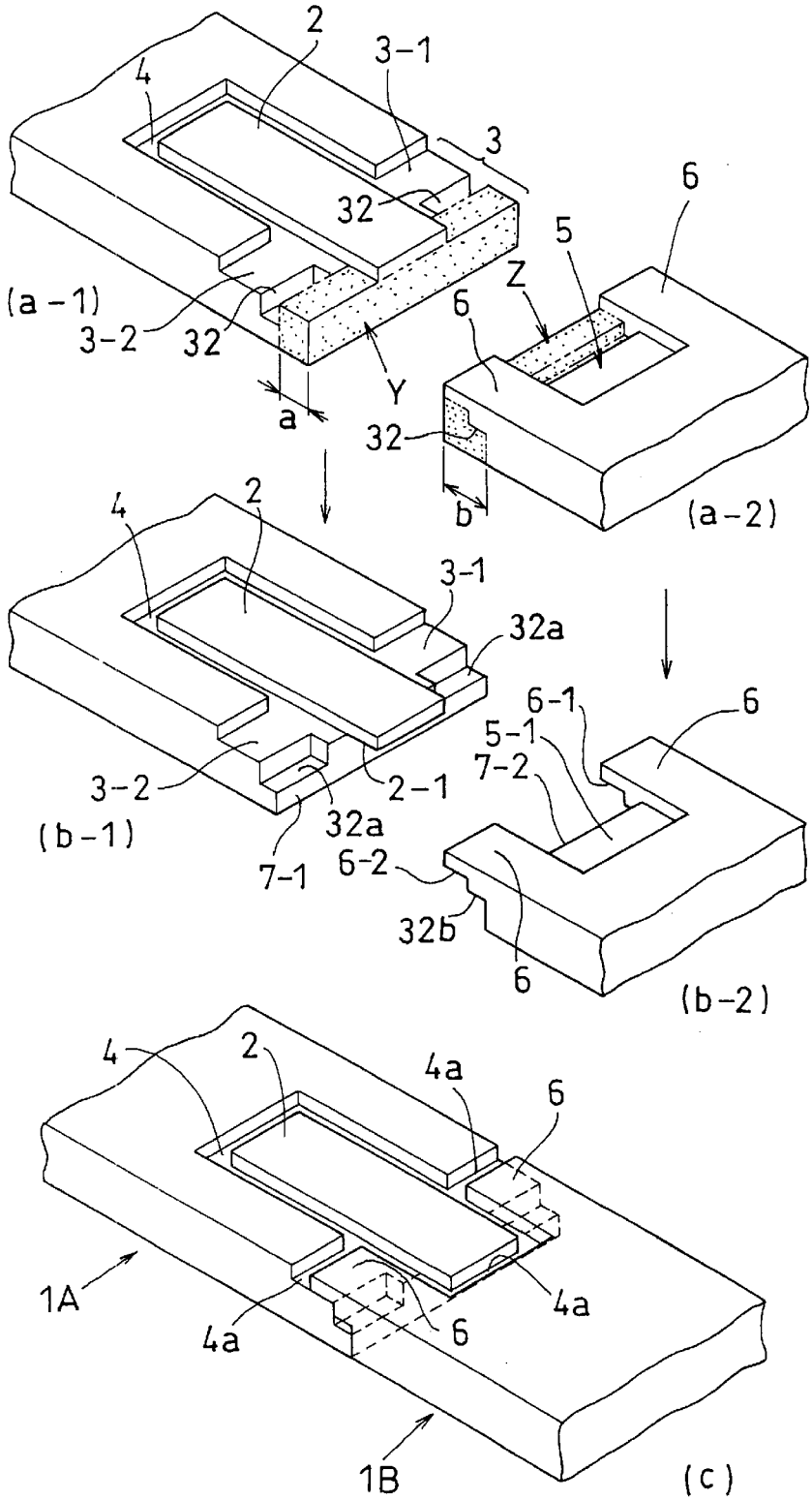
FIG. 5 is a perspective view illustrating manufacturing steps of further embodiment of a building board according to the present invention.

FIG. 5 shows further embodiment of a building board according to the present invention, which approximately corresponds, as in the case of FIG. 4, to the first embodiment shown in FIG. 3. In FIG. 5, the same members functioning in the same manner are identified by the same symbols, thereby omitting the explanation thereof. In this building board 1, the embossing work to the surface of rectangular board in the manufacture of the building board 1 is performed in such a manner that in addition to the formation of thinned region 3 on the right side of board (the right edge portion of the building board 1A), a portion of this thinned region 3 is further cut out simultaneously by means of embossing work, thereby forming a couple of deeply recessed portions 32. Further, the cut-out of material Z from the left edge portion of board (the left edge portion of the building board 1B) is performed in such a manner that the left edge portion of board is cut out to an extent which corresponds to the thickness of the thinned region 3, and then, an inner left side portion of board is further cut out to an extent which corresponds to the thickness of the deeply recessed portions 32, these cut-out work being performed throughout the entire width of each side of board. The cutting of the right side portion of board can be performed in the same manner as employed in the aforementioned first embodiment.

As a result, a step portion 32*a* having a predetermined width is formed on the contact surface side which corresponds to the underlying rabbeted portion of the right edge portion of board (the right edge portion of the building board 1A). Whereas, at the overlying rabbeted portion to be formed on the other side portion of the other building board 1B, a thickened region 32*b* increased in thickness by the height of the step portion is formed in conformity with this step portion 32*a*. This building board is featured in that, as shown in FIG. 5*c*, in addition to the linear butt joint which is to be formed by a combination of the linear end face 7-1 formed on the rear side at the right side of one building board 1A and the linear end face 7-2 formed on the rear side at the left side of the other building board 1B, a second shiplap joint constituted by the step portion 32*a* and the thickened region 32*b* to be placed into the step portion 32*a* is also formed at this linear butt joint portion.

As a result, the joint portion between the right and left building boards becomes discontinuous, thereby making it possible to enable any rain water entering this joint portion to be discharged toward the front surface of the building board. As a result, it becomes possible to reliably prevent rain water from turning into the rear side of the building board via these joint portions. Furthermore, since the aforementioned shiplap joint portion is capable of functioning as a positioning means of building boards, it is easy to perform the positioning of the joining end faces of the horizontally neighboring couple of building boards in such a manner that the linear joining end faces formed on the rear side of each of the horizontally neighboring couple of building boards are prevented from being directly contacted with each other as these building boards are positioned in place. As a result, a caulking material can be interposed at this gap between these linear joining end faces, thereby reliably ensuring the waterproofness of this joint portion.

Figure 6:
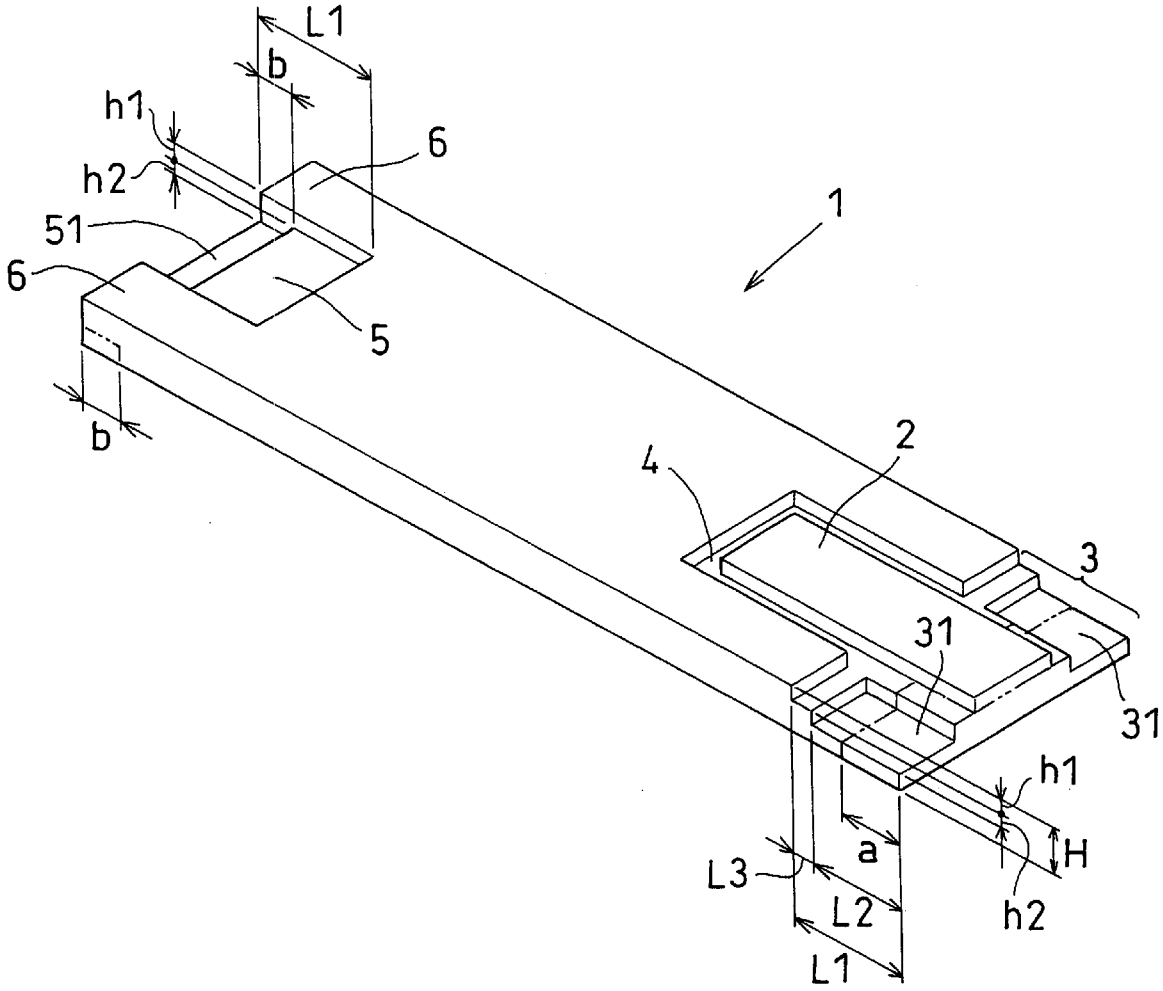
FIG. 6 is a perspective view illustrating an intermediate product of further embodiment of a building board according to the present invention.
Figure 7:
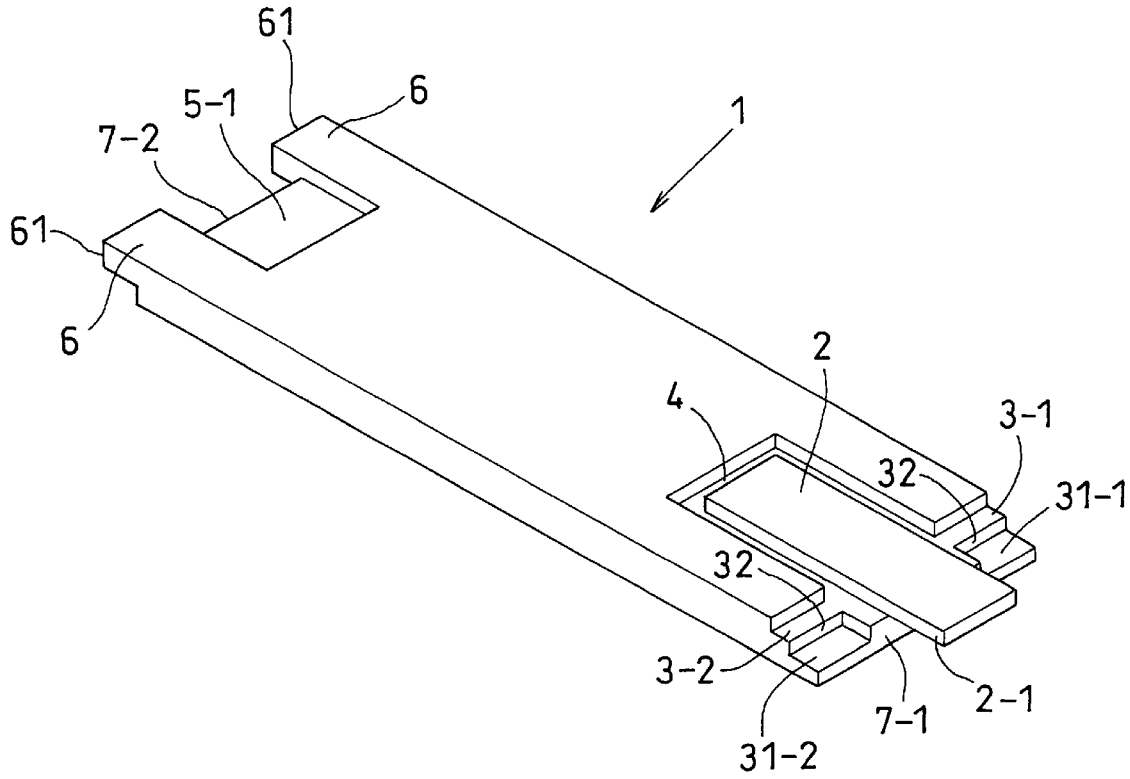
FIG. 7 is a perspective view illustrating the finished product of the building board shown in FIG. 6.
Figure 8:
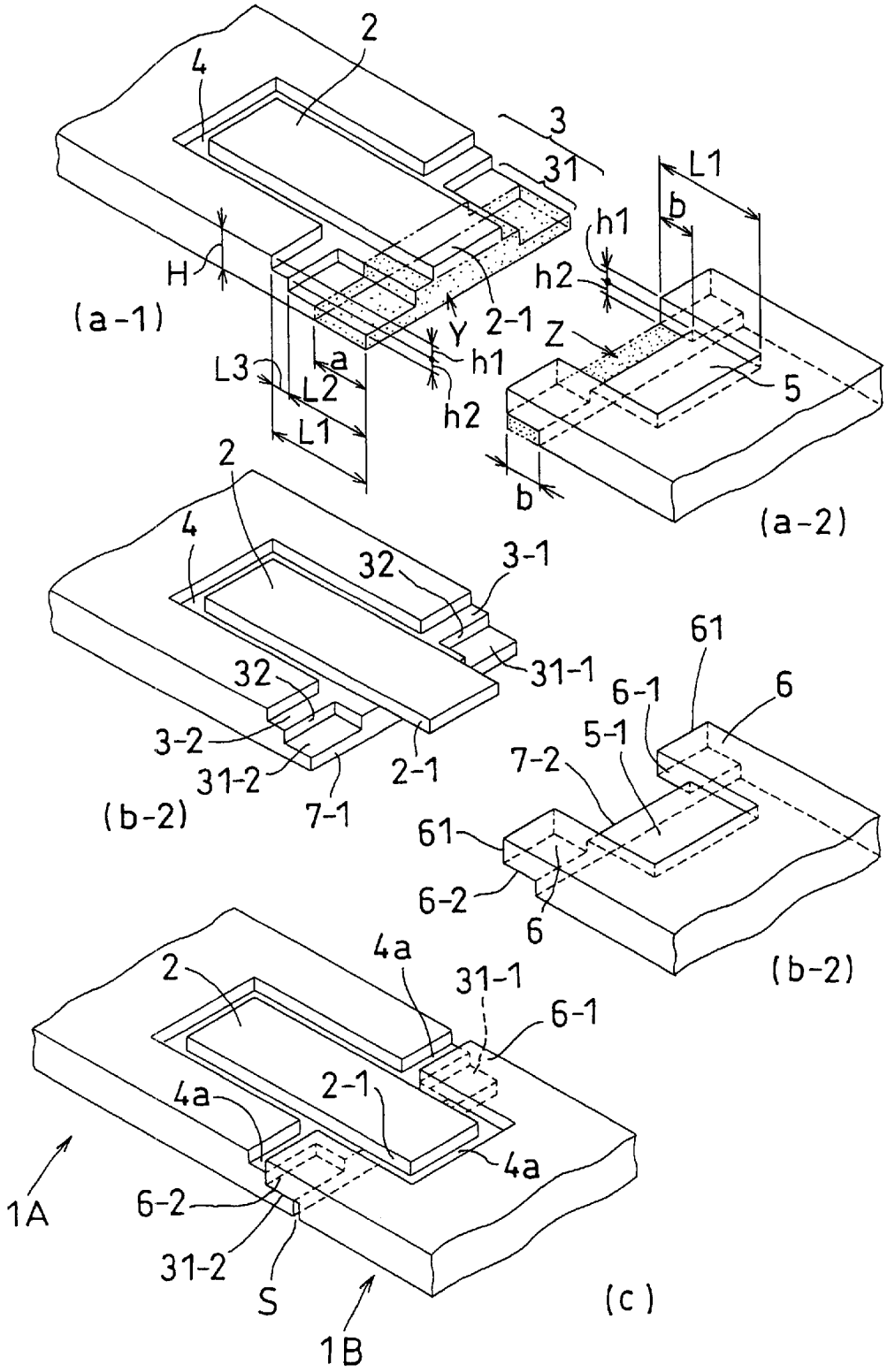
FIG. 8 is a perspective view illustrating manufacturing steps of the building board shown in FIG. 6.

FIGS. 6 to 8 shows further embodiment of a building board according to the present invention, which approximately correspond to the first embodiment shown in FIGS. 1 to 3. In FIGS. 6 to 8, the same members functioning in the same manner are identified by the same symbols, thereby omitting the explanation thereof. As shown in FIG. 6, a single protruding portion 2 is formed at approximately a central portion (in the vertical direction) of the right side of the board 1. Further, a recessed region 3 which is reduced in thickness by a depth h1 is formed respectively on the upper and lower sides of the convex portion 2, this recessed region 3 extending from the right edge of the board 1 toward the central portion of the board 1 for a distance of L1. Preferably, the depth h1 should be about ⅓ of the thickness H of the board 1. Further, a groove 4 preferably having the same depth h1 as that of the region 3 is formed around the protruding portion 2. A portion of the recessed region 3 is further recessed by a depth h2, thereby forming deeply recessed regions 31 which extends from the right edge of the board 1 toward the central portion of the board 1 for a distance of L2 (L2<L1, preferably, the value L3 (L1−L2) is the same as the width of the groove 4). Preferably, the depth h2 should be about ⅓ of the thickness H of the board 1.

On the other side of the board 1, i.e. the left side in FIG. 6, a recessed portion 5 is formed in conformity in location with the aforementioned protruding portion 2 through an embossing work, this recessed portion 5 being reduced in thickness by a depth of h1, having a lateral width (in the vertical direction) which corresponds to the total of the lateral width of the protruding portion 2 and the combined width of the grooves 4 formed on opposite sides of the protruding portion 2, and extending from the left edge of the board 1 toward the central portion of the board I for a distance of L1 (the same as that of region 3). A portion of the recessed portion 5 is further recessed by a depth h2 (the same as that of the region 31), thereby forming deeply recessed regions 51 which extends from the left edge of the board 1 toward the central portion of the board 1 for a distance of b.

Then, the intermediate product shown in FIG. 6 (the board 1 which has been subjected to the embossing work) is released from the embossing mold, and after being subjected to a curing treatment, etc., an ordinary rabbet joint-forming work (not shown) is performed, if required, on the upper and lower edges of the board, and at the same time, a cutting work is performed on the right and left sides of board as described below. This cutting work may be performed as shown in FIG. 8. Namely, a portion Y of board 1, whose distance corresponds to "a" as measured from the right edge of the board 1 toward the central portion thereof (wherein a<L2) and whose thickness corresponds to the thickness of the recessed region 3 (i.e. H-h1: ⅔ of the thickness of board) is cut off transversely along the entire width of the right edge portion (FIG. 3, a-1). As a result, an overlying rabbeted portion 2-1 extending right-ward for a distance of "a" and having a thickness h1 (⅓ of the thickness of board) as measured from the surface of board is formed on a right portion of the protruding portion 2 which is located on the right edge of the board 1. Further, a first underlying rabbeted portion 3-1 and a second underlying rabbeted portion 3-2, each having a depth h1 (⅓ of the thickness of board) as measured from the surface of board, are formed on the upper and lower sides of the protruding portion 2 excluding the portion constituting the overlying rabbeted portion 2-1. At the same time, a first deep portion 31-1 and a second deep portion 31-2, each having a depth h1−h2 (⅔ of the thickness of board) as measured from the surface of board and a width L2-a (in the longitudinal direction of board), are formed on a right side region of these first and second underlying rabbeted portions 3-1 and 3-2, respectively. Concurrently, on the rear side of the board 1, there is formed a linear end face 7-1 which is extended along the line coinciding with the right end faces of these first and second underlying rabbeted portions 3-1 and 3-2 (FIG. 8, b-1).

Figure 11:
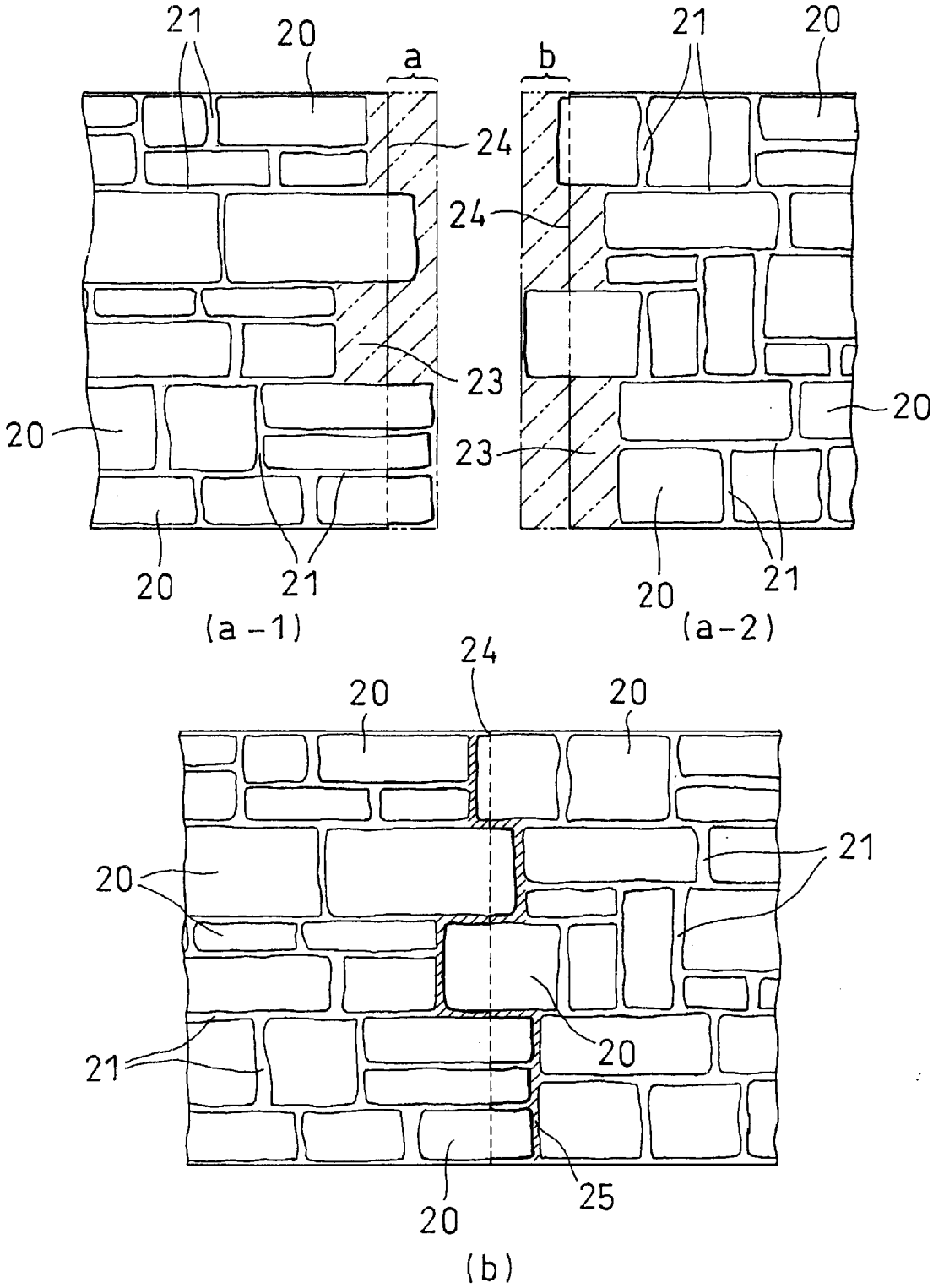
FIG. 11 is a plan view illustrating building boards and a manufacturing method thereof according to another embodiment of the present invention.

FIG. 11 illustrates one example where the embossing work for forming a protruding/recessed pattern on the entire surface of a building board is performed simultaneous with the embossing work of the side edge portions of the building board. According to the example shown in FIG. 11, a many number of island shapes having various kinds of configuration are formed as a convex pattern, and each island shape 20 is defined by a groove 21 constituting a recessed pattern, thereby providing a concave/convex pattern as a whole. The position of the side face in the vertical direction of each island shape 20 is not linearly aligned but made zigzag, thereby representing a natural feeling just like brick work, tile work or masonry work.

Likewise, a cutting work is also performed on the left side of board. Namely, a portion Z of board 1 which corresponds in distance to "b" as measured from the left edge of the board 1 toward the central portion thereof and in thickness to a thickness of H-(h1+h2) (⅓ of the thickness of board) is cut out transversely from the rear side thereof and along the entire width of the left edge portion (FIG. 8, a-2). As a result, a region located left-ward of the recessed portion 5 is cut out for a distance of "b" (by the way, the distance "b" is slightly larger than the aforementioned distance "L2-a" due to the reason to be explained hereinafter). As a result, an underlying rabbeted portion 5-1 having a width L-b (in the longitudinal direction of board), and at the same time, a first overlying rabbeted portion 6-1 and a second overlying rabbeted portion 6-2, each having a thickness h1+h2 (⅔ of the thickness of board) as measured from the surface of board and having a length of "b" as measured from the left edge of board, are formed at the regions 6 located on the upper and lower sides of the recessed portion 5. Concurrently, on the rear side of the board 1, there is formed a linear end face 7-2 which is extended along the line coinciding with the left end face of the underlying rabbeted portion 5-1 (FIG. 8, b-2).

In the installation of the building boards onto the wall of building, a many number of the building boards can be attached to the wall of building by way of a horizontal board siding while joining together the side portions of neighboring right and left building boards. As shown in FIG. 8*c*, in the installation of a couple of building boards 1A and 1B for instance, after finishing the installation of the building board 1A, a left side portion of the other building board 1B is inserted into the right side portion of the building board 1A. As a result, the overlying rabbeted portion 2-1 of the convex portion 2 formed at the right edge portion of the building board 1A is allowed to engage with the underlying rabbeted portion 5-1 formed on the left edge portion of the building board 1B, thereby achieving a shiplap engagement between the couple of building boards, and at the same time, the first deep portion 31-1 of the first underlying rabbeted portion 3-1 and the second deep portion 31-2 of the second underlying rabbeted portion 3-2, both formed on the right edge portion of the building board 1A, are allowed to engage with the first overlying rabbeted portion 6-1 and the second overlying rabbeted portion 6-2 formed on the left edge portion of the other building board 1B, respectively, thereby achieving a shiplap engagement between them. Additionally, the inner end faces 32 of the first deep portion 31-1 and the second deep portion 31-2 (FIG. 8, b-1) are brought to contact with the fore-end faces 61 of the first overlying rabbeted portion 6-1 and the second overlying rabbeted portion 6-2 (FIG. 8, b-2), respectively, thereby achieving the positioning of these building boards, and hence achieving so-called shiplap joint between the couple of building boards 1A and 1B.

As described above, since the distance of "b" is made slightly larger than the distance "L2-a", the linear end face 7-1 formed on the rear side and at the right edge portion of the building board 1A and the linear end face 7-2 formed on the rear side and at the left edge portion of the other building board 1B can be disposed face to face with a small gap S being kept retained therebetween as this couple of building boards are positioned as described above, whereby a linear butt joint is effected at this portion. Therefore, it becomes possible, in the actual installation work of building boards, to introduce a resilient sealing material into this gap S formed at this butt joint portion to thereby ensuring the waterproofness at this joint portion. In this example, a zigzag groove pattern 4*a* having the width of the groove 4 can be formed at this shiplap joint portion.

In the foregoing example, a suitable size of ceramic sheet corresponding in size to a single piece of the building board is prepared from a ceramic sheet of large size that has been manufactured according to the conventional manufacturing process, and then, the manufacturing method of the present invention is applied thereto. However, the manufacturing method of the present invention can be applied to the case where a plurality of unit boards are concurrently produced from a single raw material sheet of large size. Namely, first of all, an embossing mold (not shown) having an embossing pattern integrally comprising the pattern of the right edge portion and the pattern of the left edge portion as described with reference to FIGS. 1 to 3 is prepared as shown in FIG. 9. Then, by making use of this embossing mold, an embossing work 11 is applied simultaneously (or continuously) to plural portions of the embossing surface 10 of lengthy raw material sheet which are preset at predetermined intervals. Then, after finishing the mold releasing and curing treatment, the raw board is laterally cut along the line C.L which corresponds to the joint interface between the right and left embossing patterns (i.e. the reference line defining the region of the embossing work 11) to thereby separate it into a plurality of individual building boards. Thereafter, the opposite sides of the separated building board are subjected to the aforementioned cutting work. This method can be applied to the building board shown in FIGS. 6 to 8. In this case, the embossing work 11 shown in FIG. 10 is applied. By the way, although FIGS. 9 and 10 illustrates one example wherein a plurality of building boards are obtained by laterally cutting individual building boards, the present invention can be applied to the case wherein the molded raw board of large size is cut off both vertically and laterally so as to separate it into a plurality of individual building boards. Although not shown in the drawings, the aforementioned manufacturing method can be applied also to the building boards shown in FIGS. 4 and 5.

Although only the side edge portions of the building board are illustrated for the convenience of explanation in the foregoing description, a pattern consisting of the protruding portion 2 and the recessed groove 4 for instance, or any other kinds of pattern similar thereto may be applied to the entire surface of the building board by means of embossing work. In this case, the embossing work for forming a protruding/recessed pattern on the entire surface of the building board can be performed simultaneous with the embossing work of the side edge portions of the building board by making use of the same embossing mold.

FIG. 11 illustrates one example where the embossing work for forming a concave/convex pattern on the entire surface of a building board is performed simultaneous with the embossing work of the side edge portions of the building board. According to the example shown in FIG. 11, a many number of island shapes having various kinds of configuration are formed as a convex pattern, and each island shape 20 is defined by a groove 21 constituting a concave pattern, thereby providing a concave/convex pattern as a whole. The position of the side face in the vertical direction of each island shape 20 is not linearly aligned but made zigzag, thereby representing a natural feeling just like brick work, tile work or masonry work.

If it is desired to apply the method of the present invention to the manufacture of a building board having such a protruding/recessed pattern as mentioned above, the right edge portion of a building board as shown in FIG. 11*a*-1 is constructed such that it is formed in a zigzag groove pattern in the vertical direction so as to conform with the zigzag groove pattern in the vertical direction of the surface pattern of the building board (as represented by the left edge portion of the building board shown in FIG. 11*a*-2) and that each island shapes 20 formed in a multi-stage in the vertical direction is not divided at all. At the same time, the aforementioned recessed region 23 (a region shaded by imaginary oblique lines in FIG. 11) is formed by means of embossing work simultaneous with the embossing work for forming the protruding/recessed pattern on the surface of the building board.

Then, the intermediate product thus obtained is released from the embossing mold and subjected to a curing treatment. The aforementioned cut-out work is conducted on the resultant raw board with respect to the region having a distance "a" in the longitudinal direction as measured from the right edge thereof as well as to the region having a distance "b" in the longitudinal direction as measured from the left edge thereof. As a result, a building board having the right and left edge configurations as shown by a solid line in FIGS. 11*a*-1 and 11*a*-2 can be obtained. The region shaded by imaginary oblique lines in these FIGS. is a recessed region which is reduced in thickness from the surface thereof, constituting an underlying rabbeted portion. Further, the linear portion 24 extending in the vertical direction and formed as a result of the cut-out work constitutes an end face to be functioned as a butt joint portion. A region of the island shape 20 which is extended from the linear portion 24 is a recessed region which is reduced in thickness from the rear side of the building board, thus constituting the overlying rabbeted portion.

FIG. 11*b* shows a state wherein a couple of building boards having the aforementioned configuration are joined side by side. As it is viewed from the front side of the building board, a shiplap joint constituted by a zigzag joining face 25 is formed as shown in FIG. 11*b* by oblique lines. whereas, as it is viewed from the rear side of the building board, a linear butt joint 24 is formed. As a result, as shown in FIG. 11*b*, with respect to the joining face 25 at the shiplap joint on the front side of the building board, it becomes quite identical with the groove 21 constituting the recessed pattern in the protruding/recessed pattern on the surface of the building board, thereby completely ensuring the continuity of pattern. On the other hand, since the butt joint portion is hidden by the shiplap joint covering the front side of the butt joint portion, any gap formed by the butt joint can be hardly recognized as it is viewed externally, allowing only a discontinuous state thereof to be recognizable in the groove running horizontally at the zigzag joining face 25, thus not giving any incompatibility to anyone regarding this butt joint portion.

Figure 12:
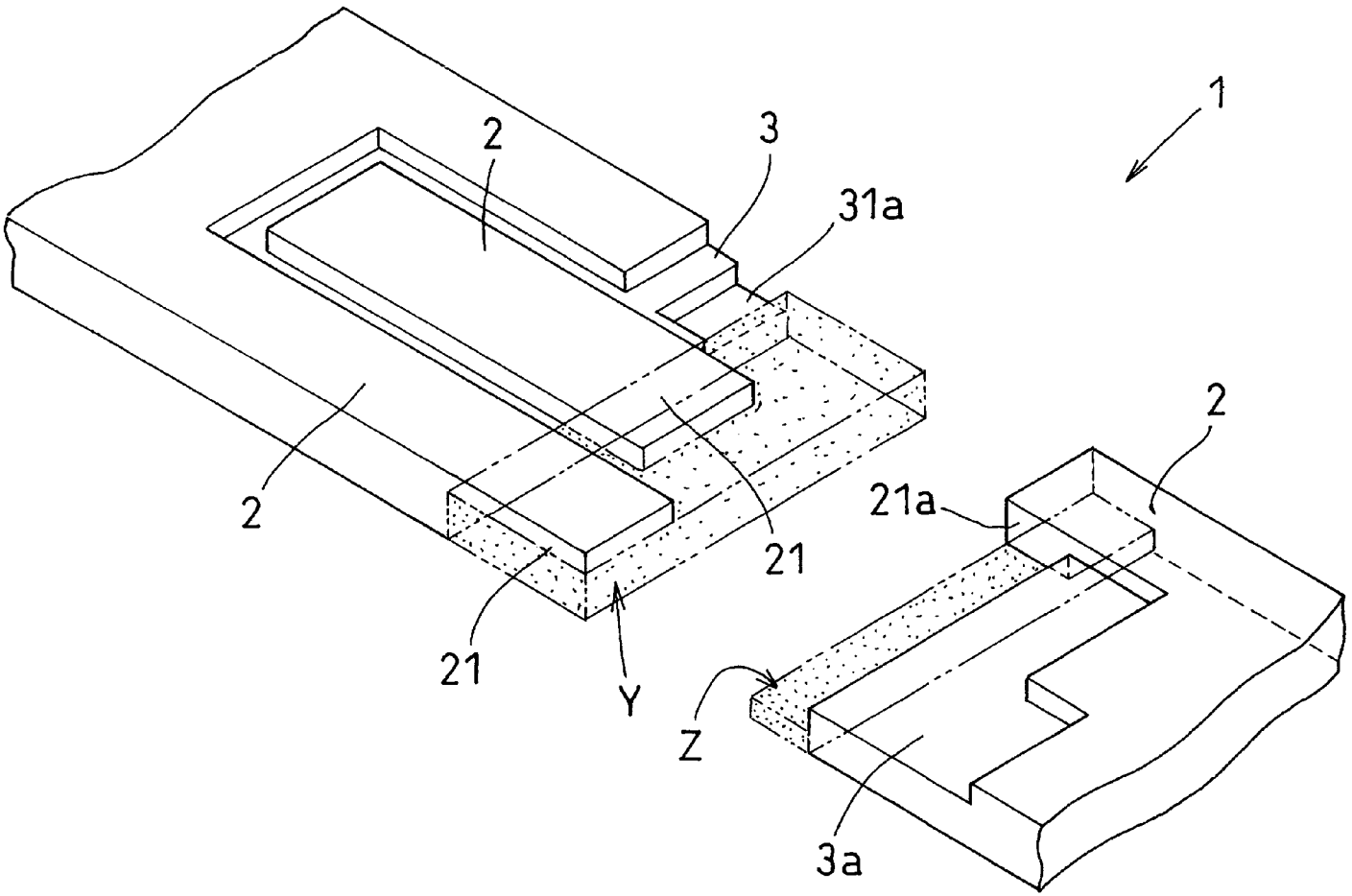
FIG. 12 is a perspective view illustrating manufacturing steps of further embodiment of a building board according to the present invention.

FIG. 12 shows another embodiment illustrating a building board of the present invention and the manufacturing method thereof. In this embodiment, a deeply recessed portion 31*a* is formed only at the underlying rabbeted portion 3 disposed at the right edge portion of the building board 1. Below this deeply recessed portion 31*a*, there are disposed, in two stages, a couple of protruding portions 2 differing each other with respect to the position of the distal ends thereof, thereby providing a couple of overlying rabbeted portions differing in length each other. The building board is provided at the left edge portion thereof with a distal end portion of the protruding portion 2 in conformity with the aforementioned deeply recessed portion 31*a*, this distal end portion constituting a thick overlying rabbeted portion 21*a*. At the region below this overlying rabbeted portion 21*a*, there is disposed an underlying rabbeted portion 3 a comprising a couple of sections differing in length each other which are formed in conformity with the aforementioned overlying rabbeted portions 21 differing in length each other. In FIG. 12, the dotted regions Y and Z are regions to be cut away.

As explained above, according to the manufacturing method of a building board of the present invention, an overlying rabbeted portion and an underlying rabbeted portion, which are required for coupling building boards with each other via opposite sides thereof while ensuring the integration and continuity of pattern, can be alternately formed by means of embossing work and shiplap joint-forming work. Therefore, this invention is applicable not only to the wall structure where building boards of the same surface design are coupled with each other, but also to the wall structure where plural kinds of building boards differing in surface design from each other are coupled with each other, thereby making it possible to easily obtain wall structure having accented design.

Figure 13:
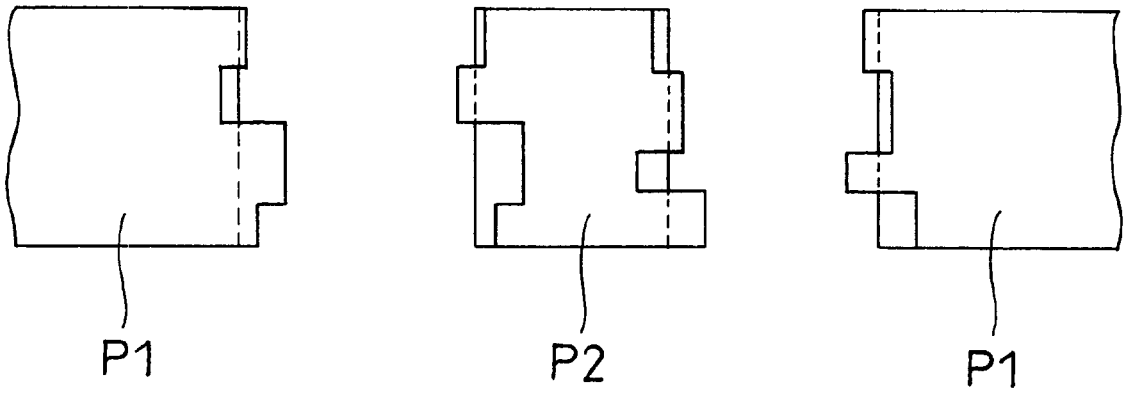
FIG. 13 is a perspective view illustrating building boards and a manufacturing method thereof according to further embodiment of the present invention.
Figure 13:
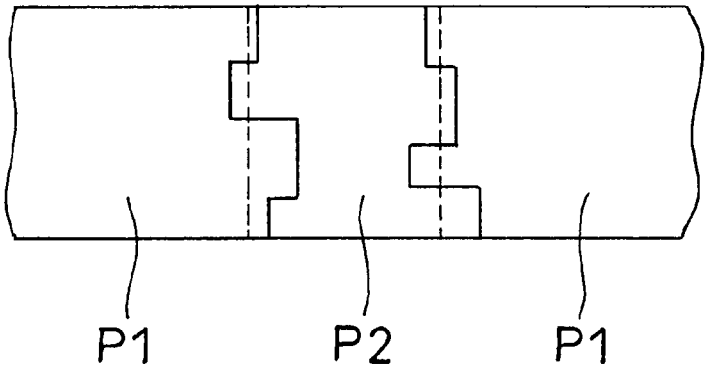

FIG. 13 illustrates such an embodiment mentioned above. Namely, as shown in FIG. 13*a*, a building board P1 having a first island pattern and a building board P2 having a second island pattern are subjected in advance to the working according to the method of the present invention so as to form shiplap joint portions as well as butt joint portions which are then coupled with each other to thereby form, as shown in FIG. 13*b*, a joint structure having, on its surface, shiplap joint portions each having a different configuration of zigzag joint, thereby making it possible to produce an exterior design which is rich in variation.

In the foregoing description, only the embodiments wherein the present invention is applied to the joint of right and left edge portions of a building board are explained in detail. However, in addition to such embodiments, the present invention is also applicable to the joint of top and bottom ends of a building board or to all of the joints including the joint of right and left edges as well as the joint of top and bottom ends of a building board. Especially, the method of the present invention is advantageous when it is applied to the joint of top and bottom ends of a building board in the respect that even if a step portion happens to be generated between an upper building board and a lower building board due to non-uniformity in thickness of building boards, the step portion would not stand out so much.

What is claimed is:

1. A building board comprising:

a front surface having a protruding and recessed pattern; and opposite ends having at least one overlying rabbeted portion and at least one underlying rabbeted portion for respectively overlapping and fitting under corresponding underlying and overlying rabbeted portions;

wherein at least one overlying rabbeted portion is formed by one end portion of a protruding portion of said pattern; each underlying rabbeted portion is constructed to have an area bigger than an area of a corresponding overlying rabbeted portion formed by said protruding portion of said pattern on the opposite end; and each of said opposite ends is provided with a linear end contact surface adjacent to a rear surface of said building board for matching with a corresponding end contact surface on an end of another building board, sad end contact surfaces having a constant height.

2. The building board according to claim 1, wherein one of said linear end contact surfaces is provided with a tongue, and the other of said linear end contact surfaces is provided with a groove for enabling said tongue to be fitted therein.

3. The building board according to claim 1, wherein at least one underlying rabbeted portion is provided on a contact surface side thereof with a step portion having a predetermined width; and the portion of said overlying rabbeted portion corresponding to said step portion has an increased thickness which is increased by the height of said step.

4. The building board according to claim 1, wherein at least one underlying rabbeted portion is provided with a deeply recessed portion which is opened toward the end of said building board; and a portion of said overlying rabbeted portion which corresponds to said deeply recessed portion is formed to have an increased thickness which is larger than other portions of said overlying rabbeted portion by a magnitude corresponding to that of said deeply recessed portion.

5. The building board according to any one of claims 1 to 4, wherein each protruding portion has a shape like an island surrounded by said recessed portion, and said overlying rabbeted portions and underlying rabbeted portions are disposed on the ends of the building board in a manner to avoid the formation of a linear joint on a front surface of the building board when a pair of said building boards are joined with each other.

6. A building board comprising:

a front surface having a protruding and recessed pattern; and opposite ends having at least one overlying rabbeted portion and at least one underlying rabbeted portion for respectively overlapping and fitting under corresponding underlying and overlying rabbeted portions;

wherein an overlying rabbeted portion at a first end is formed by one end portion of a protruding portion of said pattern and an overlying rabbeted portion at a second end is formed by a cutout portion of a rear surface of the building board; an underlying rabbeted portion on the first end is formed by a cut-out portion in the front surface of the board and an underlying rabbeted portion at the second end is formed by a recessed portion of the pattern.

* * * * *